US006620241B2

(12) United States Patent
Gambini

(10) Patent No.: US 6,620,241 B2
(45) Date of Patent: Sep. 16, 2003

(54) GLUING UNIT OF A TAIL END OF A LOG

(76) Inventor: Giovanni Gambini, Via A. Omodeo 7, I-56124 Pisa (IT)

( * ) Notice: Subject to any disclaimer, the term of this patent is extended or adjusted under 35 U.S.C. 154(b) by 3 days.

(21) Appl. No.: 09/965,029

(22) Filed: Sep. 26, 2001

(65) Prior Publication Data

US 2002/0040676 A1 Apr. 11, 2002

(30) Foreign Application Priority Data

Oct. 11, 2000 (IT) ..... MI2000A2195

(51) Int. Cl.[7] ..... B05C 1/02

(52) U.S. Cl. ..... 118/257; 118/106; 156/446; 156/578

(58) Field of Search ..... 118/208, 106, 118/257; 427/207.1; 156/578, 446

(56) References Cited

U.S. PATENT DOCUMENTS 5,242,525 A * 9/1993 Biagiotti ..... 156/357

6,372,064 B1 * 4/2002 Butterworth et al. ..... 156/64

* cited by examiner

*Primary Examiner*—Laura Edwards
(74) *Attorney, Agent, or Firm*—Hedman & Costigan, P.C.

(57) ABSTRACT

Gluing unit of a tail end of a log fitted in a load-bearing structure (12) of a machine to produce logs, in which the structure (12) comprises an inclined surface (13) for feeding logs (14) and in which fitted at the end of the inclined surface (13) is a rotating selector (15), equipped with a series of pockets (15*a*), to receive individual logs (14) and feed these towards an actual gluing unit (11). This gluing unit (11) comprises in succession a lower unwinding roller (16) and an upper conveyor belt (17) and, moreover, immediately downstream of the unwinding roller (16) a feed roller (18) followed by a suction roller (19), connected to a vacuum source, and a glue dispensing device (20), and also provided above the unwinding roller (16) and feed roller (18) with a blowing component (27) to blow a final end (21) of the log (14) and a photocell (28) which interacts to detect the final end (21) of the log (14).

4 Claims, 2 Drawing Sheets

GLUING UNIT OF A TAIL END OF A LOG

The present application claims priority to Italian Patent Application Serial No. MI 2000A 002195, filed Oct. 11, 2000.

BACKGROUND OF THE INVENTION

The present invention relates to a gluing unit of a tail end of a log.

In order to produce rolls of toilet tissue, kitchen paper and similar, denominated "logs", once the paper has been rolled, the state of the art method is to distribute or position glue in various ways both on a tail end of the individual log and on a portion of the roll of which the log is composed to obtain firm reciprocal binding of the finished log.

In fact, glue is used to join the final end and the remaining part of the winding, which can then be cut into several rolls of the limited dimension required, thus obtaining several finished rolls.

Currently, this deposition of glue is performed either using dispensers to spray the glue or by making the tail end or the roll pass over a slit where glue is dispensed by overflow, once a portion of the tail end has been unwound from the rest of the roll.

These state of the art gluing units, although functioning very well, may not allow glue to be dispensed and distributed evenly and in the exact position desired.

In fact, with the use of dispensers to spray glue, as the glue is distributed by means of the aforesaid dispensers, this distribution is not always continual and straight and glue may also be deposited on parts of the paper where it is not desired or tends to dirty the entire machine. Moreover, it must be considered that the dispensers are complicated and must be checked and adjusted in order not to use too much or, in contrast, too little glue.

When, on the other hand, glue is made to flow from an overflow, over which the tail end of the roll or the roll itself passes, fouling of the entire machine and even the roll may occur, due to the amount of glue and glue that is transported by the paper or spills from the overflow unintentionally.

Moreover, it must be taken into consideration that units to glue a tail end of a log are particularly complicated from the constructional point of view, in general, and from the point of view of interaction between the various parts which feed the log, unwind the tail end, or at least a portion of this, and permit the glue to be positioned on this.

SUMMARY OF THE INVENTION

The object of the present invention is therefore to identify a different solution to the technical problem above for correct dispensing or positioning of the glue, solving the problems of prior art related to the entire gluing unit of the tail end of the log.

Another object is to produce a unit capable of performing the job mentioned above that is particularly simple to operate, also in the presence of a high productivity level.

These objects according to the present invention are obtained by producing a gluing unit of a tail end of a log fitted in a load-bearing structure (12) of a machine to produce logs, in which said structure (12) has an inclined surface (13) for feeding logs (14) arriving from a re-reeling machine and in which provided at the end of said inclined surface (13) is a rotating selector (15), equipped with a series of pockets (15*a*), to retrieve individual logs (14) and feed said logs (14) towards a gluing unit (11), wherein said gluing unit (11) comprises in succession a lower unwinding roller (16) and an upper conveyor belt (17) and, immediately downstream of said unwinding roller (16) a feed roller (18) followed by a suction roller (19), connected to a vacuum source, and a wire (20), and also provided over said unwinding roller (16) and said feed roller (18) with a blowing component (27) to blow a final end (21) of said log (14) and a photocell (28) that interacts to detect said final end (21) of the log (14), wherein said glue dispensing device comprises said wire (20), which is fitted crosswise to the feed direction both of said log (14), and said final end (21), wherein said wire (20) collects glue (26) in a tank (25) while rotating on end pulleys (22).

Further important characteristics and details of 'the present invention are set forth in the dependent claims.

BRIEF DESCRIPTION OF THE DRAWINGS

The characteristics and advantages of a gluing unit of a tail end of a log according to the present invention shall become clearer and more evident from the description below, provided merely as an exemplary and non-limiting embodiment with reference to the annexed drawings, in which.

DETAILED DESCRIPTION OF THE INVENTION

Figure 1:
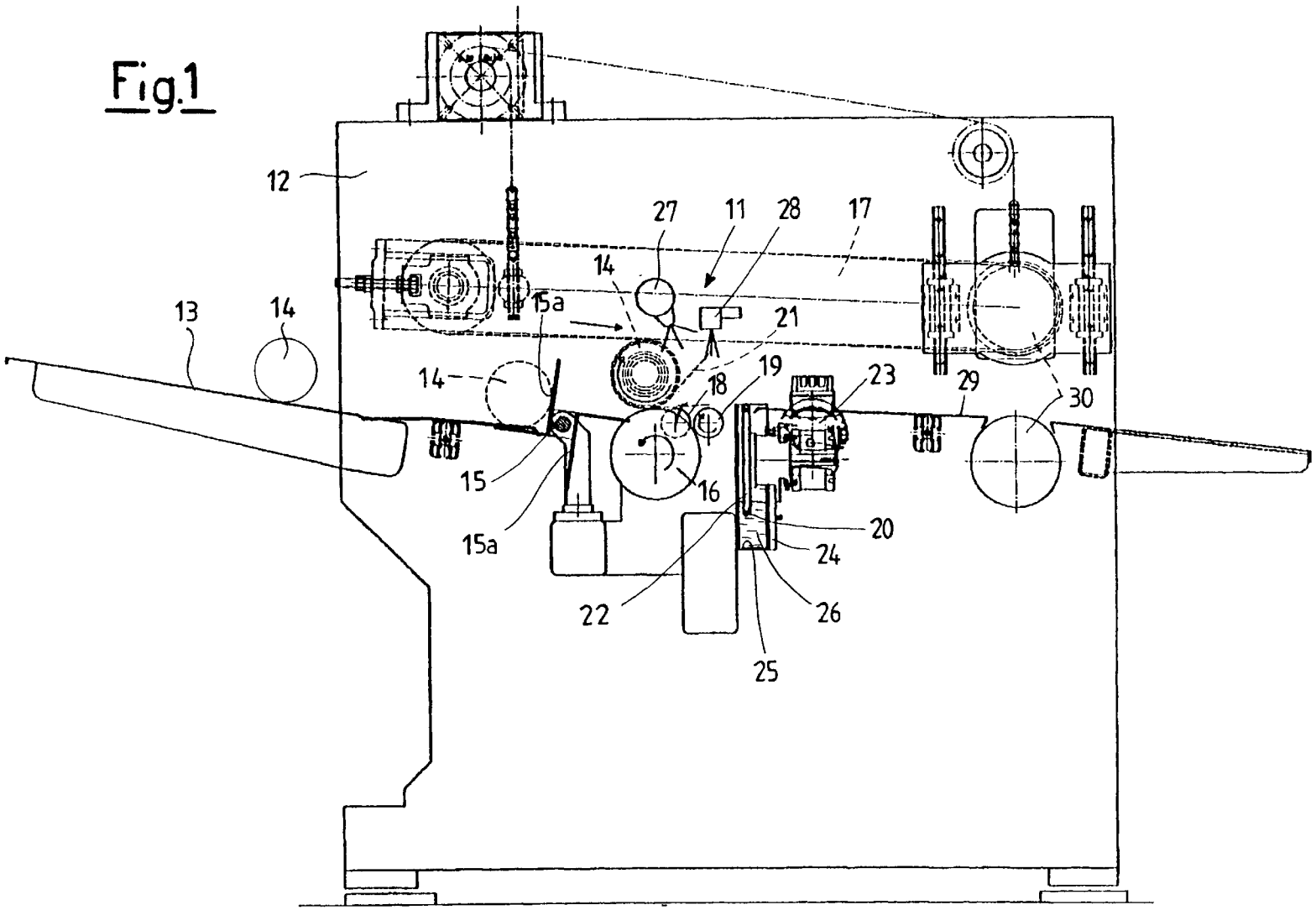
FIG. 1 is a side elevation view, partly sectional, of a unit according to the present invention in a first operating position in which the log is blocked between an unwinding roller and a feed belt.
Figure 2:
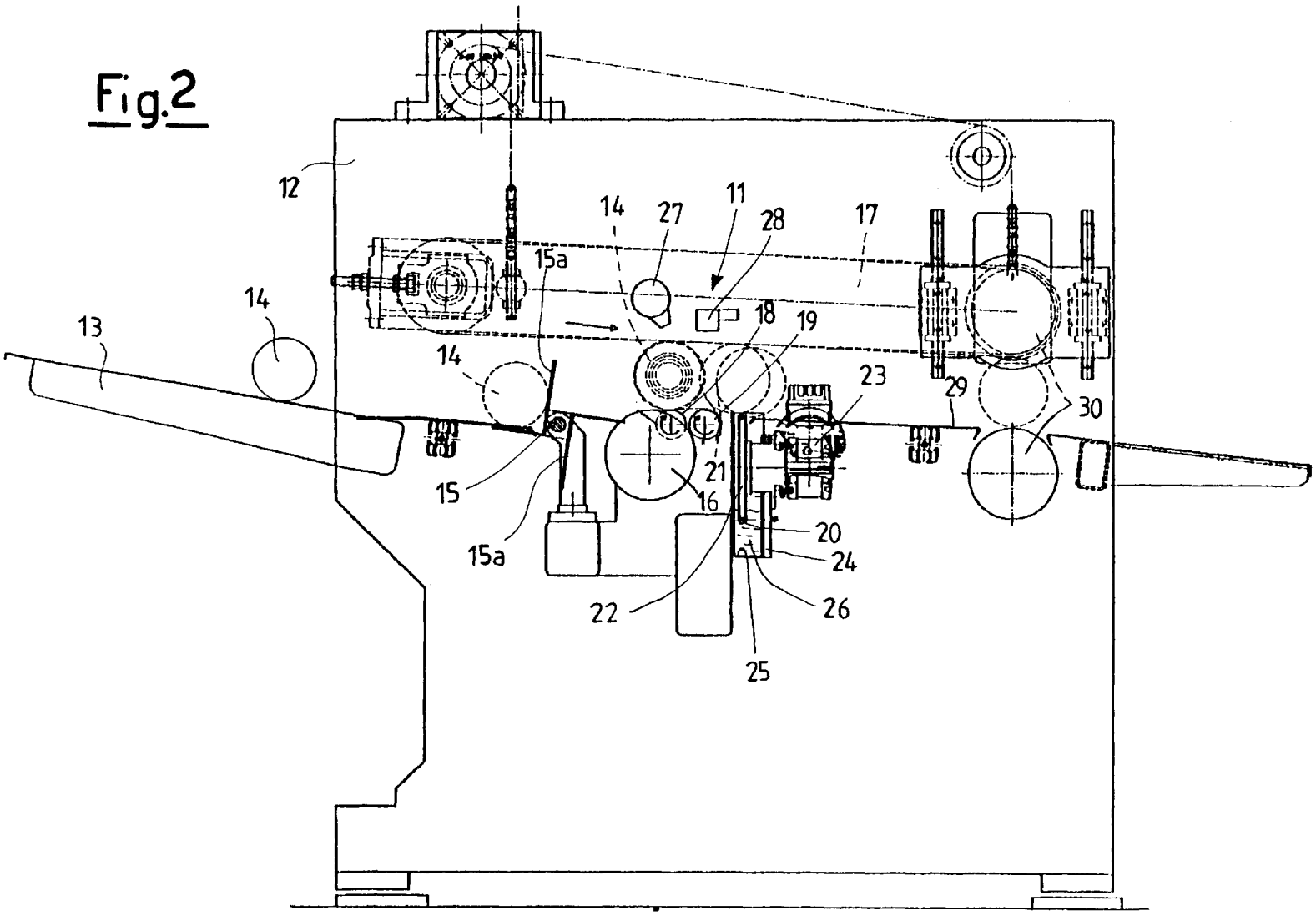
FIG. 2 is a similar view to the one shown in FIG. 1 in a subsequent operating position, where a dashed line also indicates the position in which the roll receives the glue from a wire to distribute this.

With generic reference to FIGS. 1 and 2, these show a gluing unit of a tail end of a log, indicated as a whole with 11, provided in a machine for producing logs. Fitted on a load-bearing structure 12 of the machine is an inclined surface 13 to feed logs 14 coming from a preceding re-reeling machine.

The end of the inclined surface 13 is fitted with a rotating selector 15 of the star type, equipped with a series of pockets 15*a*, which receives the individual logs and feeds them towards the actual gluing unit 11.

According to the present invention, this gluing unit 11 has an unwinding roller 16, which is composed for example of a series of unwinding rollers, spaced, coaxial and connected inflexibly, positioned below an upper conveyor belt 17, which extends over the entire gluing unit 11.

Positioned immediately downstream of the unwinding roller 16 is a feed roller 18, composed for example of a series of feed rollers, spaced, joined and coaxial to one another, followed by a suction roller 19, connected to a vacuum source (not shown) and for this purpose provided with a perforated surface.

Also provided is a device to dispense glue comprising a wire 20 which is positioned crosswise to the feed direction both of a tail end 21, which extends from the log or roll 14 of paper, and of the log 14. The wire 20 in the example is of the closed ring type, wound on end pulleys 22, in example two, only one of which is shown and at least one of which is governed in continuous rotation by a gear motor 23. The pulleys 22 are supported rotatably on walls 24 of a tank 25.

In fact, the wire 20 is made to pass inside the tank 25 containing a special glue 26 suitable for the use specified above and rotating along its course over the pulleys 22 collects and carries the glue 26 to deposit it on the paper. The wire 20 is thus provided with a lower branch that collects the glue and an upper branch which releases the glue on the paper, log or roll. For example, the tank 25 may be closed in the shape of a box and may be provided at an upper end with a length of the wire 20, free towards the outside and projecting, which has collected and transports the glue 26 before rotating on the pulleys it returns inside the tank 25 to collect more glue. The glue is therefore deposited on the paper in the form of a crosswise strip (not shown).

At the top, in addition to the conveyor belt 17, at least one blowing component 27 is provided, which acts to open the final end 21 from the rest of the log or roll 14. Moreover, there is a photocell 28, which also interacts with the final end 21 of the log 14, detecting its presence.

Lastly, an inclined ejection surface 29 is provided, positioned beyond which are a pair of rollers 30 that guarantee binding between the tail or final end 21 of the log 14 and the log or roll itself 14, to ensure the glue 26 binds.

Operation of a gluing unit of a tail end of a log of material 11 positioned in a machine to produce the finished log is extremely simple.

The rolls 14, wound almost to their final dimension, are fed onto the inclined surface 13 coming from a preceding re-reeling machine, positioned in the line.

Each single roll 14 is positioned in a pocket 15*a* of the rotating selector 15 and is then fed according to a predetermined sequence towards the gluing unit 11 of the present invention.

In fact, the roll 14 is positioned on the unwinding roller 16, located below, and is held in place by the upper conveyor belt 17. The unwinding roller 16 rotates counter-clockwise, while the conveyor belt 17 moves forward to hold the roll 14 in place, although allowing it to rotate. In this way the final end 21 of the roll 14 is carried, by rotation of the roll 14, to the blowing component 27 (FIG. 1). This blowing component 27 acts to open the final end 21 from the rest of the roll 14 and the photocell 28 detects that this aperture has occurred to a sufficient extent over the suction roller 19.

At this point the unwinding roller 16 stops and the continuous forward movement of the upper conveyor belt 17 determines feed of the roll 14 with the final end 21 separate and open.

The feed roller 18 cooperates in correct forward positioning of this final end 21 so that this final end 21 is positioned on the suction roller 19 (FIG. 2). The suction roller 19, rotating clockwise, tends to grasp the final end 21 of the paper of the roll 14 being processed and rolls this around itself.

At this point the feed roller 18 stops rotation and immediately after this the suction roll 19 also stops rotation.

This causes lack of stability of the roll 14, which was held in this position by the rotation of the rollers 18 and 19 and the feed of the upper conveyor belt 17. However, by continuing to move forwards, the latter determines feed of the roll 14 while the final end 21, separate and open from the roll 14, is held in position by the halted suction roller 19 (dashed line in FIG. 2).

It is evident that the roll 14 passing over the upper branch of the wire 20 provided with glue, receives a portion of this which is positioned according to a line that can be identified as a generic generating line of the roll 14.

When this passage has been performed the roll 14 is provided with a line of glue and the suction roll 19 can interrupt suction, releasing the final end 21 of the roll 14.

The roll 14 is then drawn forwards by the continuous movement of the upper conveyor belt 17 and passes onto the inclined ejection surface 29. As stated, positioned beyond this inclined ejection surface 29 are a pair of rollers 30 that act on the roll 14, provided with the line of glue, and on the final end 21 of this, pressing them together. This guarantees binding between the tail or final end 21 of the roll 14 and the roll itself 14, to ensure the glue 26 binds.

The log is then ready to be fed to the subsequent cutting-off machine which will produce a number of small rolls of the required dimensions.

It has thus been seen that a gluing unit of a tail end of a log of material 11 according to the present invention accomplishes the objects indicated previously.

The unit is particularly simple in structure and does not require to be surrounded by complicated equipment.

Moreover, owing to the presence of only a few rollers and the conveyor belt, it is particularly compact and contained in limited spaces.

The wire 20 used as glue dispenser on the roll prevents any type of undesired fouling and also prevents unnecessary waste of glue, by dispensing only the metered quantity it carries.

The perforated suction roller 19 permits the tail end of the roll to be held in position so that the line of glue can be deposited on the roll by the wire.

The unit of the present invention thus designed is susceptible to numerous modifications and variants, without departing from the scope of the present invention.

Moreover, in practice the materials, their dimensions and components used may vary according to technical requirements.

What is claimed is:

1. Gluing unit of a tail end of a log fitted in a load-bearing structure (12) of a machine to produce logs, in which said structure (12) has an inclined surface (13) for feeding logs (14) arriving from a re-reeling machine and in which provided at the end of said inclined surface (13) is a rotating selector (15), equipped with a series of pockets (15*a*), to retrieve individual logs (14) and feed said logs (14) towards a gluing unit (11), wherein said gluing unit (11) comprises in succession a lower unwinding roller (16) and an upper conveyor belt (17) and, immediately downstream of said unwinding roller (16) a feed roller (18) followed by a suction roller (19), connected to a vacuum source, and a wire (20), and also provided over said unwinding roller (16) and said feed roller (18) with a blowing component (27) to blow a final end (21) of said log (14) and a photocell (28) that interacts to detect said final end (21) of the log (14), wherein said glue dispensing device comprises said wire (20), which is fitted crosswise to the feed direction both of said log (14), and said final end (21), wherein said wire (20) collects glue (26) in a tank (25) while rotating on end pulleys (22).

2. Gluing unit as claimed in claim 1, characterised in that said unwinding roller (16) rotates counter-clockwise, while said suction roller (19) rotates clockwise, said conveyor belt (17) being made to advance continuously.

3. Gluing unit as claimed in claim 1, characterised in that said unwinding roller (16) is composed of a series of unwinding rollers, spaced, coaxial and connected inflexibly.

4. Gluing unit as claimed in claim 1, characterised in that said feed roller (18) is composed of a series of unwinding rollers, spaced, coaxial and connected inflexibly.

* * * * *